US008146682B2

(12) United States Patent
Rhinehart et al.

(10) Patent No.: US 8,146,682 B2
(45) Date of Patent: Apr. 3, 2012

(54) APPARATUS AND METHODS OF MILLING A RESTRICTED CASING SHOE

(75) Inventors: Bill Rhinehart, The Woodlands, TX (US); Thomas M. Redlinger, Houston, TX (US); Thurman B. Carter, Spring, TX (US); Wei Xu, Houston, TX (US); Hubert E. Halford, Rosharon, TX (US); Martin Stulberg, Angleton, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 216 days.

(21) Appl. No.: 12/098,341

(22) Filed: Apr. 4, 2008

(65) Prior Publication Data

US 2008/0245532 A1 Oct. 9, 2008

Related U.S. Application Data

(60) Provisional application No. 60/910,098, filed on Apr. 4, 2007.

(51) Int. Cl.
*E21B 7/28* (2006.01)
*E21B 29/00* (2006.01)

(52) U.S. Cl. ..... 175/53; 175/401; 175/406; 166/55.6; 166/298

(58) Field of Classification Search ..... 175/57, 175/53, 406, 401, 269; 166/55.6, 298
See application file for complete search history.

(56) References Cited

U.S. PATENT DOCUMENTS

| | | | | |
|---|---|---|---|---|
| 1,857,616 | A * | 5/1932 | Baker | 175/269 |
| 2,438,673 | A * | 3/1948 | McMahan | 175/267 |
| 2,450,223 | A * | 9/1948 | Barbour | 175/271 |
| 6,598,678 | B1 | 7/2003 | Simpson et al. | |
| 6,679,328 | B2 | 1/2004 | Davis et al. | |
| 6,732,817 | B2 | 5/2004 | Dewey et al. | |
| 6,880,650 | B2 * | 4/2005 | Hoffmaster et al. | 175/263 |
| 7,004,264 | B2 | 2/2006 | Simpson et al. | |
| 7,117,957 | B2 | 10/2006 | Metcalfe et al. | |
| 7,140,444 | B2 | 11/2006 | Mackay | |
| 7,182,157 | B2 * | 2/2007 | Zupanick | 175/267 |
| 2004/0134687 | A1 | 7/2004 | Radford et al. | |

FOREIGN PATENT DOCUMENTS

| | | |
|---|---|---|
| EP | 0 257 943 | 3/1988 |
| GB | 2 410 045 | 7/2005 |
| WO | WO 93/16833 | 9/1993 |

OTHER PUBLICATIONS

PCT Search Report from Application No. PCT/US2008/059487 dated Aug. 1 8, 2008.
Canadian Office Action for Application No. 2,682,316 dated Apr. 26, 2011.

* cited by examiner

*Primary Examiner* — Hoang Dang
(74) *Attorney, Agent, or Firm* — Patterson & Sheridan, LLP

(57) ABSTRACT

A method of removing a restriction in a tubular located in a well includes providing a drilling assembly with a drill bit and a reamer, the reamer having a cutting structure for removing the restriction; drilling through a lower portion of the tubular; expanding the reamer at a location below the restriction; and urging the reamer back toward the restriction to remove the restriction.

28 Claims, 8 Drawing Sheets

APPARATUS AND METHODS OF MILLING A RESTRICTED CASING SHOE

CROSS REFERENCE TO RELATED APPLICATIONS

This application claims benefit of U.S. Provisional Patent Application Ser. No. 60/910,098, filed Apr. 4, 2007, which application is incorporated herein by reference in its entirety.

BACKGROUND OF THE INVENTION

1. Field of the Invention

The present invention relates to an apparatus and methods for removing a restriction in a tubular. Particularly, embodiments of the present invention relate to apparatus and methods for milling a restricted drill shoe. More particularly, embodiments of the present invention relate to apparatus and methods for milling a restricted drill shoe coupled to an expanded tubular.

2. Background of the Related Art

In the oil and gas exploration and production industry, bores are drilled from surface to access subsurface hydrocarbon reservoirs. The bores are typically drilled in sections: a section of bore is drilled using drilling apparatus including a bit mounted on the end of a string; the drilling apparatus is pulled out of the bore; a section of bore-lining tubing is run into the "open" bore; and the tubing is then cemented or otherwise sealed in the bore by filling the annulus between the tubing and the bore wall with cement slurry. These drilling and lining steps are repeated until the bore is of the required length or depth. Clearly, this can be a time-consuming operation as to drill and line each bore section it is necessary to make up and then dismantle first a drill string and then a running string, both of which may be several thousand meters long.

Furthermore, with conventional bore-lining techniques, the outer diameter of each section of bore-lining tubing must be smaller than the inner diameter of the preceding tubing to enable the tubing to be run into the bore. Thus, a step-wise reduction in bore diameter occurs at the transition between each bore section. The reduction in available bore diameter limits the production capabilities of the well, restricts access to the well, and also requires the use of smaller diameter and thus generally less robust drilling apparatus in the lower portions of the well. A further disadvantage also arises in that the upper portions of the bore may have to be drilled to a relatively large diameter, in light of the numerous subsequent diameter reductions that must be accommodated, which increases drilling time and expense.

Some of these disadvantages may be overcome by the use of expandable bore lining tubing. Generally, the expandable tubular is run in through a section of existing tubing and then expanded to a larger diameter. In this respect, the size of the inner diameter may be substantially preserved.

The expandable tubular 10 typically includes a casing shoe 20 at its lower end such that the cementing operation may be performed. See FIG. 1. To continue drilling, the casing shoe 20 must be removed. However, because the casing shoe 20 is not expanded, a small portion 15 of the expandable tubular is also not expanded. See FIG. 2. This unexpanded portion 15 becomes a restriction in the wellbore and may pose a problem for continued drilling. This is because most drill bits adapted to drill the well are not suitable for drilling through the tubular's steel composition. One solution is to make two trips into the well. First, a bit or mill coupled to a reaming tool is run in to drill or mill out the restricted section. Then, a drilling assembly is run-in to deepen or drill the well.

There is a need, therefore, for apparatus and methods to remove a restriction in a well and drill another section of the well in a single trip. There is also a need for apparatus and methods to remove a drill shoe from an expanded tubular and extend the well in a single trip.

SUMMARY OF THE INVENTION

The present invention provides a method of removing a restriction in a tubular located in a well. The method includes providing a drilling assembly with a drill bit and a reamer, the reamer having a cutting structure for removing the restriction; drilling through a lower portion of the tubular; expanding the reamer at a location below the restriction; and urging the reamer back toward the restriction to remove the restriction. In another embodiment, the method further includes continuing drilling to extend the well after expanding the reamer and before urging the reamer to remove the restriction. In yet another embodiment, the reamer is provided with a second cutting structure for drilling the well.

In another embodiment, an apparatus for removing a restriction in a tubular located in a well includes a drilling assembly having a drill bit and a reamer, wherein the reamer includes a cutting arm movable between an unexpanded position and an expanded position, wherein the cutting arm includes a first cutting zone adapted to drill the well and a second cutting zone adapted to mill the restriction.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore, not to be considered limiting of its scope, for the invention may admit to other equally effective embodiments.

FIG. 11 shows the expandable tubular of FIG. 2 after the drill bit has passed through.

DETAILED DESCRIPTION OF THE PREFERRED EMBODIMENT

The present invention provides a method of removing a restriction in a tubular located in a well. The method includes providing a drilling assembly with a drill bit and a reamer, the reamer having a cutting structure for removing the restriction; drilling through a lower portion of the tubular; expanding the reamer at a location below the restriction; and urging the reamer back toward the restriction to remove the restriction.

Figure 1:
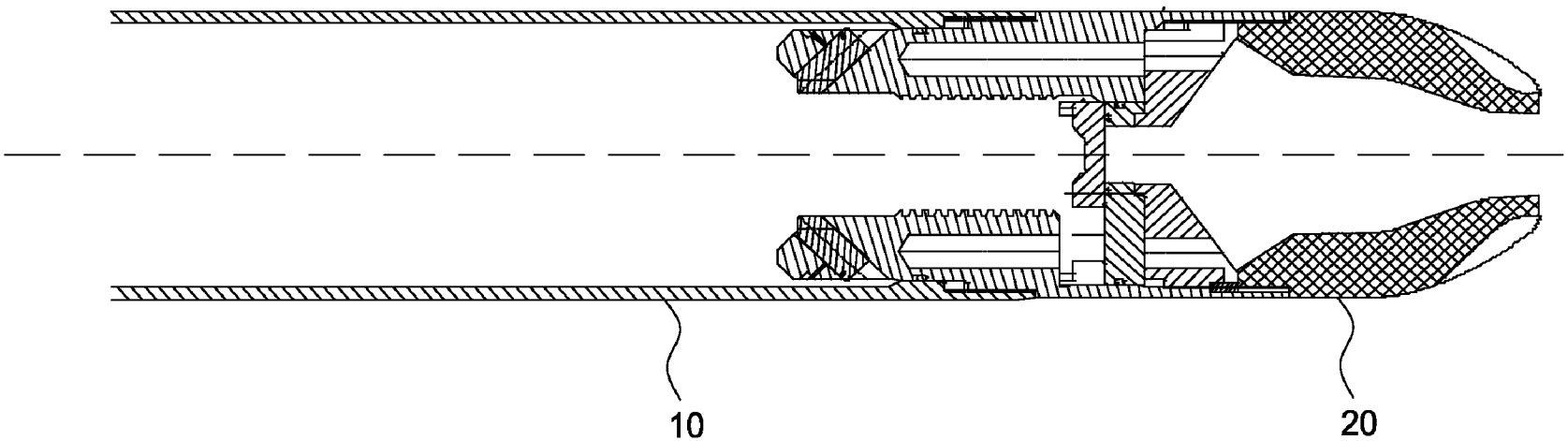
FIG. 1 shows an expandable tubular equipped with a casing shoe.
Figure 2:
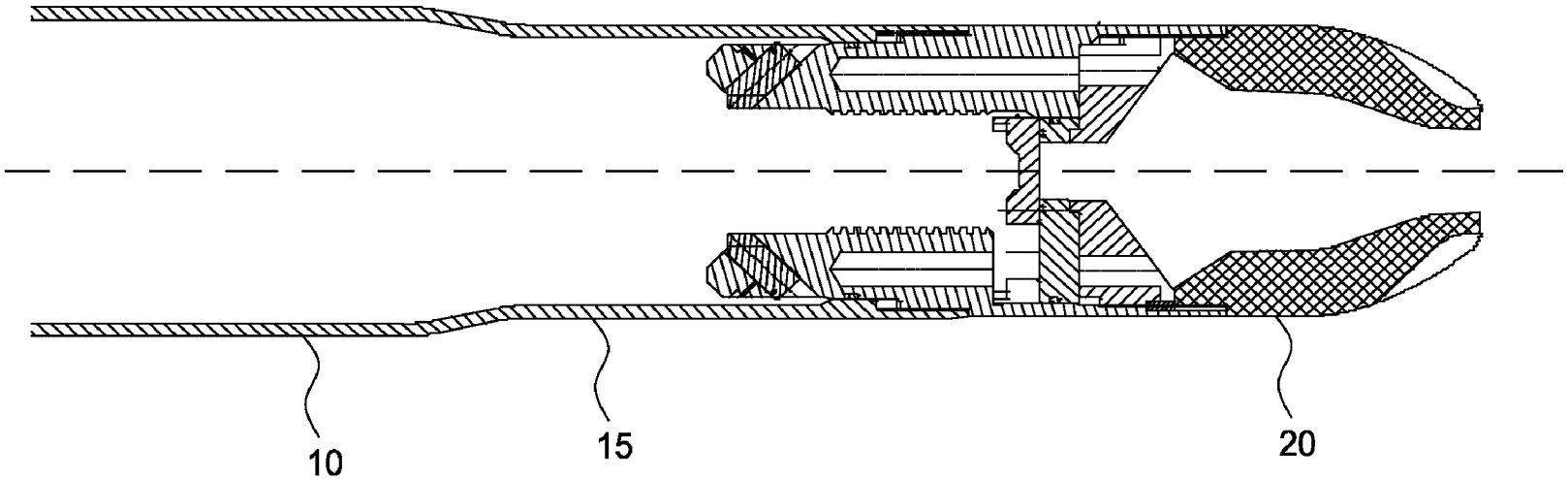
FIG. 2 shows the expandable tubular in an expanded configuration.
Figure 3:
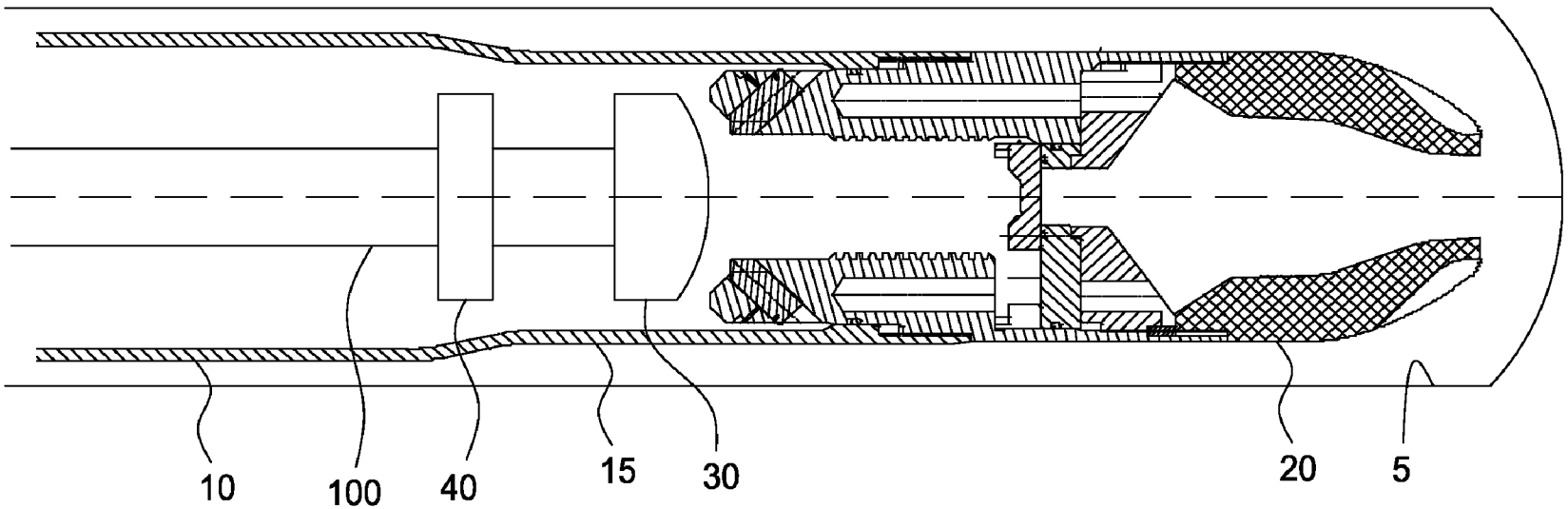
FIG. 3 shows an embodiment of the drilling assembly positioned in the expandable tubular.

FIG. 3 is a schematic view of an embodiment of a drilling assembly 100 having a drill bit 30 and an expandable reamer 40 adapted to extend the well 5 and remove the restriction 15. The drilling assembly 100 is shown positioned in the expandable tubular 10 of FIG. 2. The drill bit 20 may be fitted with cutting structures suitable for extending the well 5 and removing the casing shoe 20 as is known to a person of ordinary skill in the art. In one embodiment, the casing shoe 20 is manufactured from steel, composites, aluminum, bronze, or combinations thereof to facilitate its removal. Preferably, the drill bit 30 is adapted to cut a diameter substantially equal to the unexpanded inner diameter of the expandable tubular.

Figure 4:
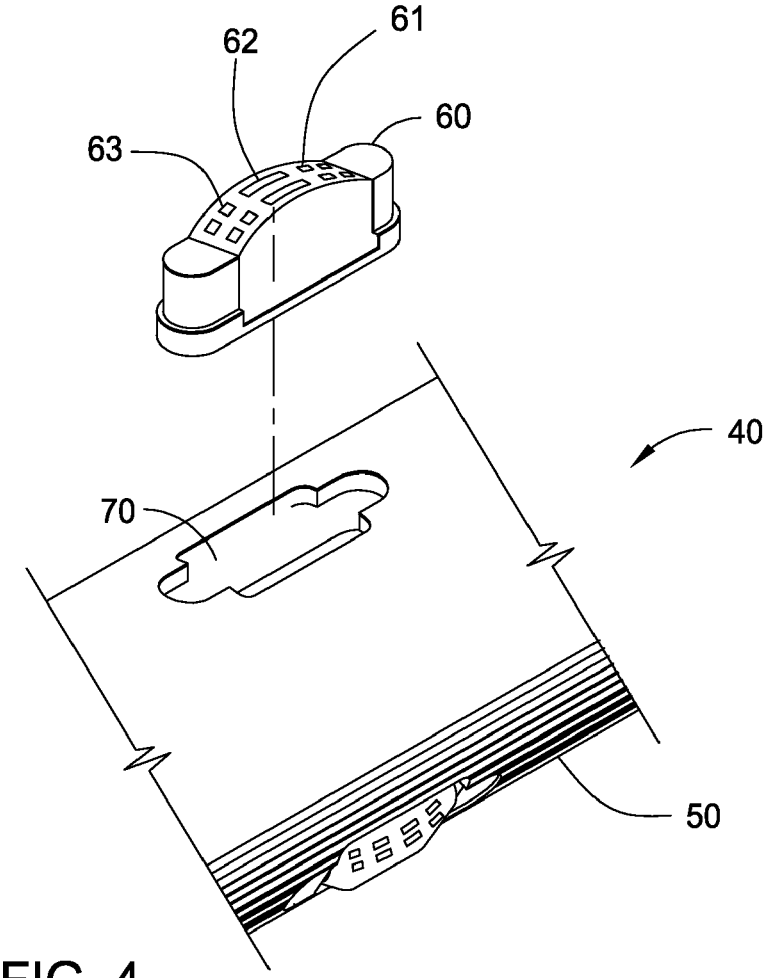
FIG. 4 shows a partial perspective view of an embodiment of the expandable reamer.
Figure 5:
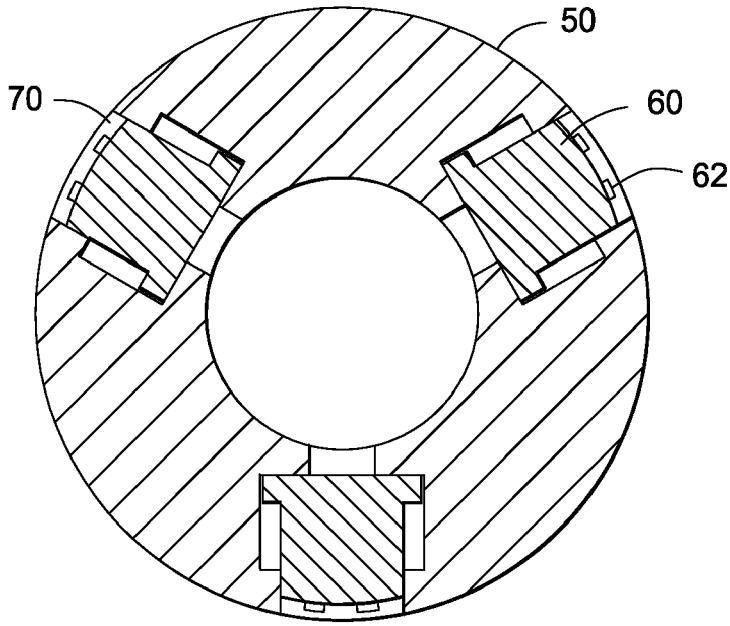
FIG. 5 is a cross-section view of the expandable reamer.

Referring to FIGS. 4 and 5, the expandable reamer 40 includes a tubular body 50 having a flow bore 55 extending therethrough. FIG. 4 is a partial perspective view of the expandable reamer 40. FIG. 5 is a cross-section view of the expandable reamer 40. The tubular body 50 may be connected directly to the drill bit 30 or through a drill sub (not shown). The tubular body 50 may include one or more cutting arms 60 that are movable between an unexpanded position and an expanded position. The cutting arms 60 are positioned in a complementary recess 70 formed on the tubular body 50. The cutting arms 60 may be expanded using fluid pressure supplied through the flow bore 55. In one embodiment, the cutting arms 60 are adapted to expand at a pressure higher than the minimum pressure required for operating the drill bit 30. In this respect, the cutting arms 60 may be actuated independently from the drill bit 30. Upon expansion, the cutting diameter of the expandable reamer should be larger than the unexpanded inner diameter, but smaller than the expanded inner diameter of the expanded tubular.

The cutting arms 60 are adapted to drill, mill, or ream in either axial direction. The cutting surface of the cutting arm 60 is provided with one or more cutting structures suitable for cutting the intended material. In one embodiment, the cutting surfaces may be divided into three zones, front, middle, and back. The cutting structures in each zone may be adapted to cut the same or different material. For example, the front zone 61 may be provided with cutting structures suitable to drill the formation. Such exemplary cutting structures include PDC, natural diamond, tungsten carbide, composite tungsten carbide, hard metal, and combinations thereof. The back zone 63 may be provided with cutting structures suitable to ream or mill carbon steel. Such exemplary cutting structures include tungsten carbide, composite tungsten carbide, hard metal, PDC, and combinations thereof. The middle zone 62 may be provided with a cutting structure for either drilling the formation or reaming carbon steel. In another embodiment, the middle zone 62 may be provided with a friction reducing material to facilitate axial and rotational movement of the cutting arms 60. Another suitable reamer is disclosed in U.S. Pat. No. 6,732,817, issued to Dewy et al., which patent is herein incorporated by reference in its entirety.

Figures 6, 7, 8, 9, 10:
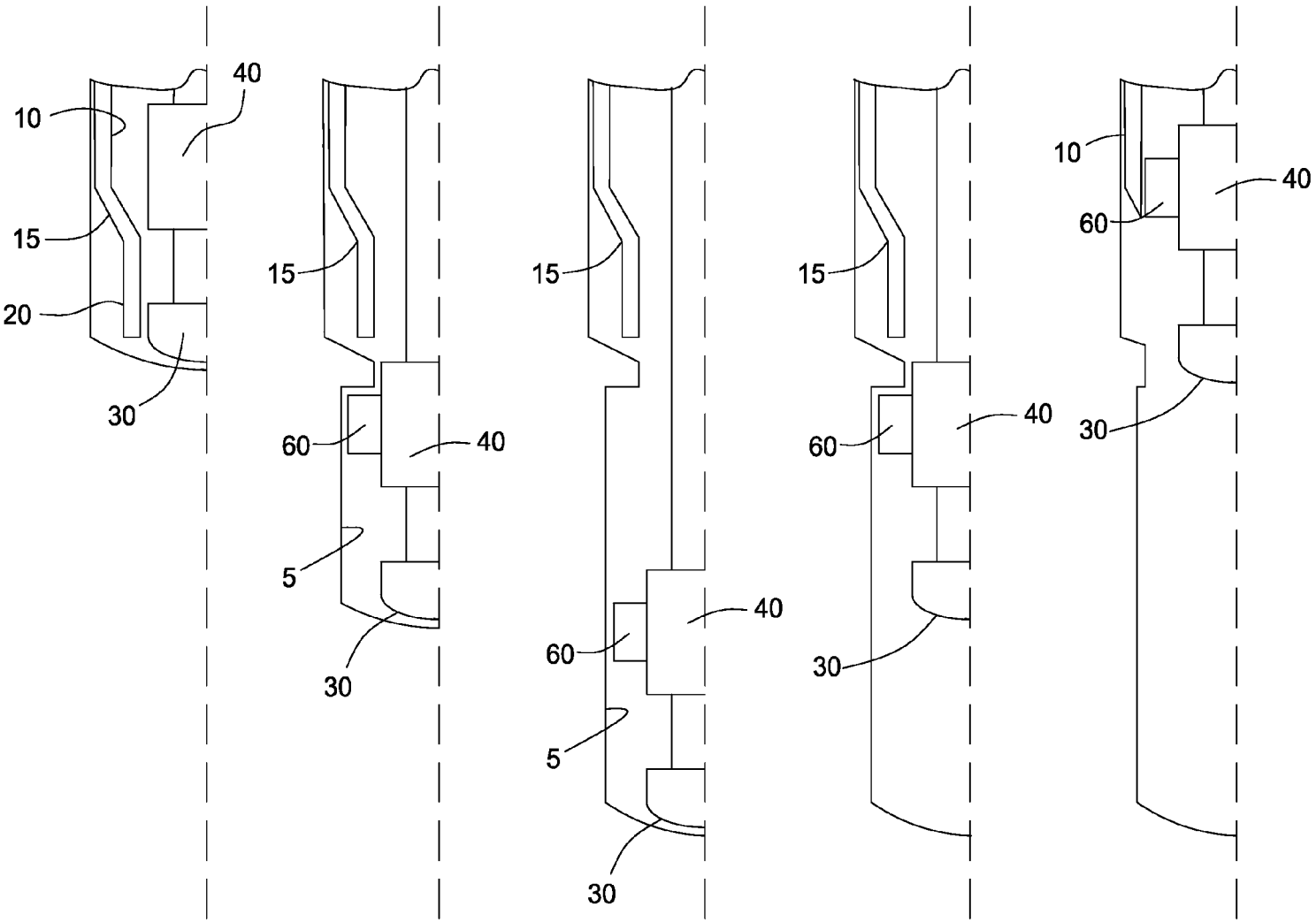
FIGS. 6-10 shows an exemplary sequential operation of the drilling assembly.

In operation, the drill bit 30 is rotated to drill out the casing shoe 20. The drilling fluid pressure should be below the activating pressure for the expandable reamer 40. FIG. 6 shows the casing shoe 20 substantially drilled out and the expandable reamer 40 in the unactivated position. When the expandable reamer 40 has moved below the expandable tubular 10, the drilling fluid pressure is increased to activate and expand the cutting arms 60 of the reamer 40, as shown in FIG. 7. The drilling assembly 30, 40 may optionally continue to drill and extend the well 5 to the desired depth, as shown in FIG. 8. To drill the well, front and middle cutting zones 61, 62 of the cutting arm 60 are provided with a PDC cutting structure. After drilling to the desired depth, the drill string including the expandable reamer 40 is pulled backwards toward the expandable tubular 10, as shown in FIG. 9. The back cutting zone 63 of the cutting arms 60 is provided with a cutting structure such as tungsten carbide to mill the restriction section 15 of the expandable tubular 10. In one embodiment, the outer diameter of the expanded cutting arms 60 is sized to effectively remove at least a portion of the restriction section 15. For example, the outer diameter of the expanded cutting arms 60 is larger than the unexpanded diameter of the expandable tubular 10. In this respect, the expanded cutting arms 60 may be used to remove the restriction section 15, thereby leaving the larger, expanded inner diameter portion of the expandable tubular 10, as shown in FIG. 10. In this manner, the restriction 15 in the tubular 10 may be removed and the well 5 extended in a single trip.

Figure 11:
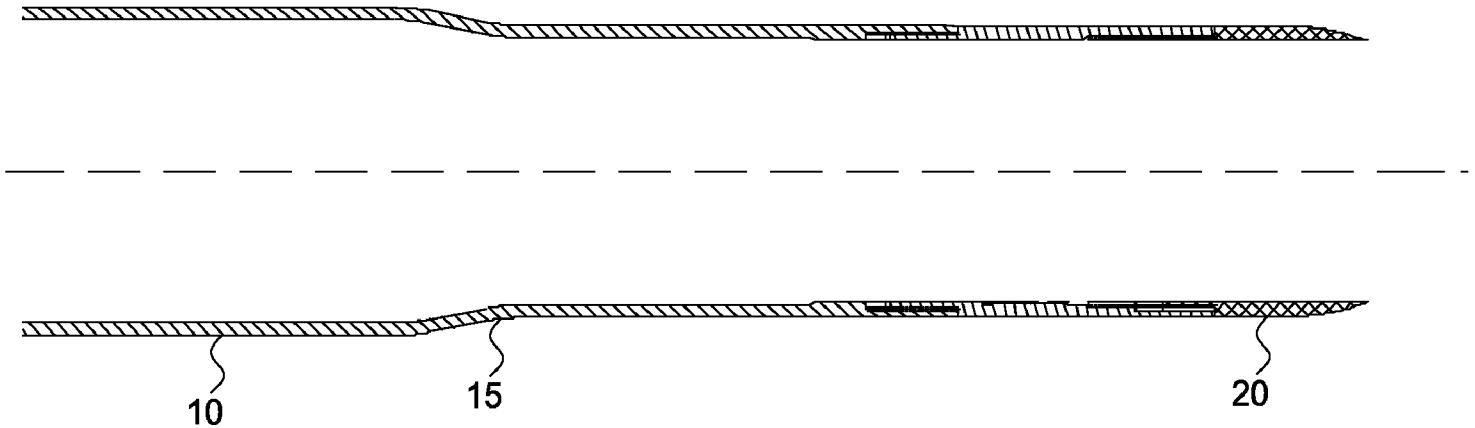
Figure 12:
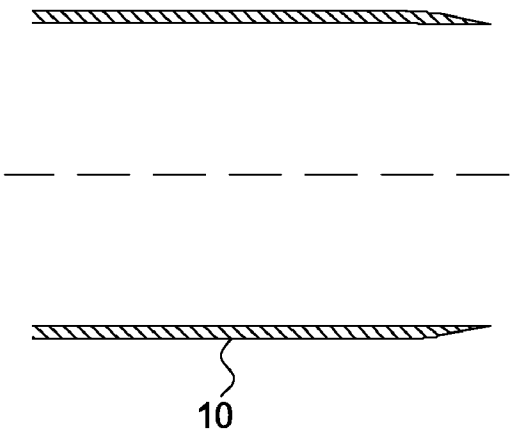
FIG. 12 shows the expandable tubular of FIG. 11 after expandable reamer has removed the restriction.

FIG. 11 shows the expandable tubular 10 and casing shoe 20 of FIG. 2 after the drill bit 30 has drilled through the casing shoe 20. It can be seen that the drill bit 30 has removed portions of the casing shoe 20 that is within its cutting diameter, thereby leaving behind a tubular shaped remainder portion. FIG. 12 shows the expandable tubular 10 of FIG. 11 after expandable reamer 40 has removed the restriction 15 and the remainder portion of the casing shoe 20.

Figure 13:
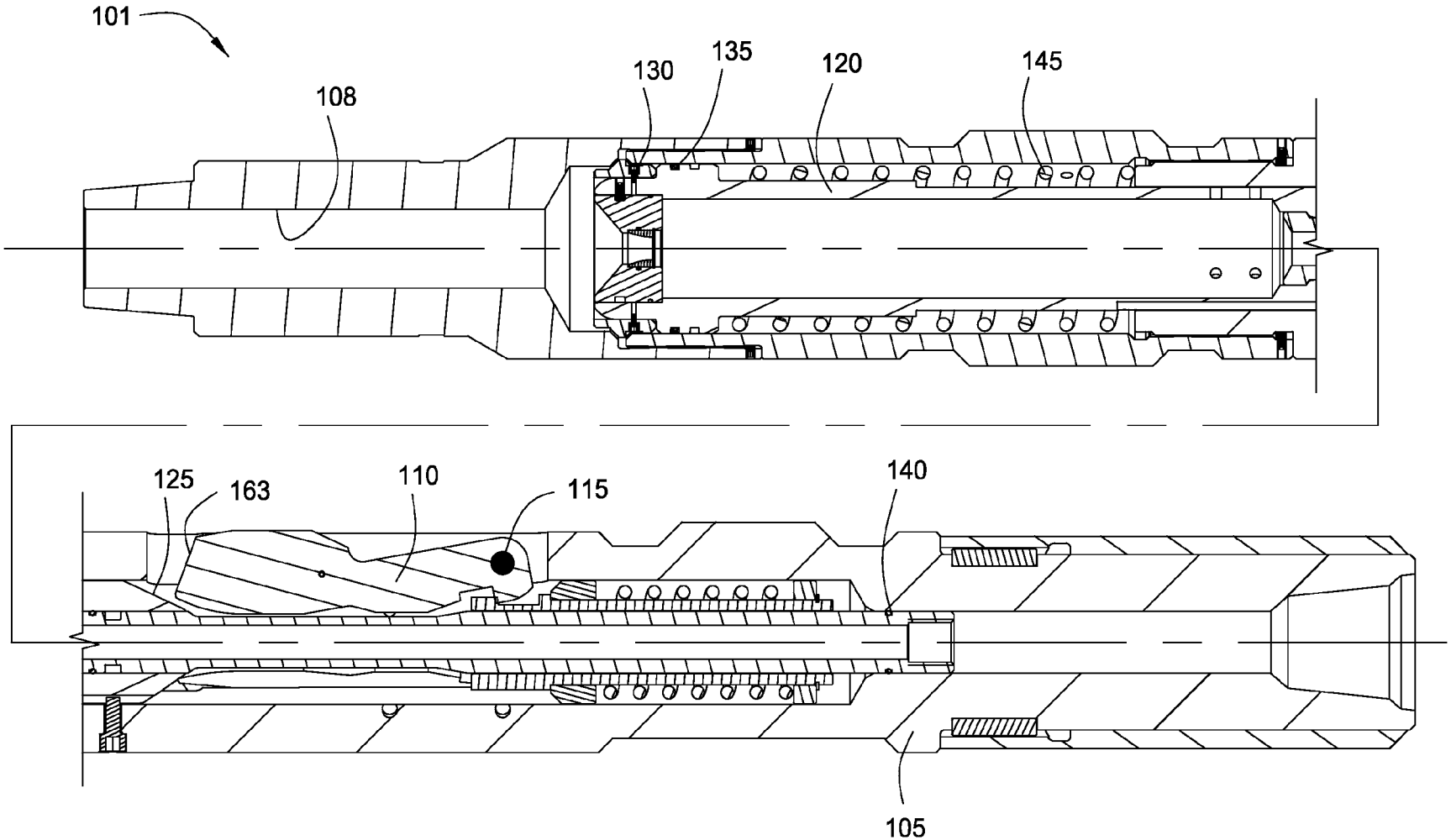
FIG. 13 shows another embodiment of an expandable reamer in an unexpanded configuration.

FIG. 13 shows another embodiment of an expandable reamer 101 in an unexpanded configuration. The reamer 101 has an outer body 105 and a bore 108 extending therethrough. One or more cutting arms 110 are circumferentially coupled to the reamer's outer body 105. For example, three cutting arms 110 may be positioned 1200 apart around the outer body 105. In one embodiment, one end of the cutting arm 110 is coupled to the outer body 105 using a hinge connection such that the cutting arm 110 is rotatable about the hinge pin 115. The reamer 101 also includes a piston 120 disposed in the bore 108 and interior to the cutting arm 110. The outer surface of the piston 120 includes a ramp 125 disposed adjacent the free end of the cutting arm 110. Seals 135, 140 are provided between piston 120 and the outer body 105 such that the piston 120 may be moved by a fluid pressure in the bore 108. A biasing member such as a spring 145 is provided between piston 120 and the outer body 105 to maintain the piston 120 in the unactivated position. A shear screw 130, or other suitable shearable connection, may be optionally used to connect the piston 120 to the outer body 105 to temporarily hold the piston 120 in the unactivated position until a fluid pressure sufficient to the break the shearable connection is encountered. Preferably, the shear pressure is greater than the activation pressure of the motor to operate the drill bit.

The reamer 101 also includes a cutting arm return mechanism 150. In one embodiment, the return mechanism 150 includes a movable sleeve disposed between the piston 120 and the outer body 105. The sleeve has an abutment for engagement with the cutting arm 110. The sleeve is biased in the arm retracted position using a biasing member such as a spring. During run-in, the spring biases the sleeve in a direction away from the cutting arm 110. In this respect, the abutment maintains the cutting arm 110 in the retracted position. When the cutting arm 110 is urged outward by the ramp 125, the cutting arm 110, through the abutment, applies a compressive force on the spring. After the ramp 125 is retracted from under the cutting arm 110, the spring is allowed to expand and pull the cutting arm 110 inward to the retracted position.

In operation, the cutting arms 110 of the reamer 101 may be activated to extend the wellbore or remove the restriction portion 15 of the expandable tubular 10. For example, after the drill bit has removed portions of the casing shoe 20, fluid pressure in the bore 108 is increased to shear the shearable screw 130, thereby freeing the piston 120 for movement in the bore 108. The pressure applied overcomes the biasing force of the spring 145 to cause the piston 120 and the associated ramp 125 to move toward the cutting arm 110. The ramp 125 forces the cutting arm 110 outward, thereby expanding the cutting arms 110 and exposing the cutting zones 161-163 of the cutting arm 110.

Figure 14:
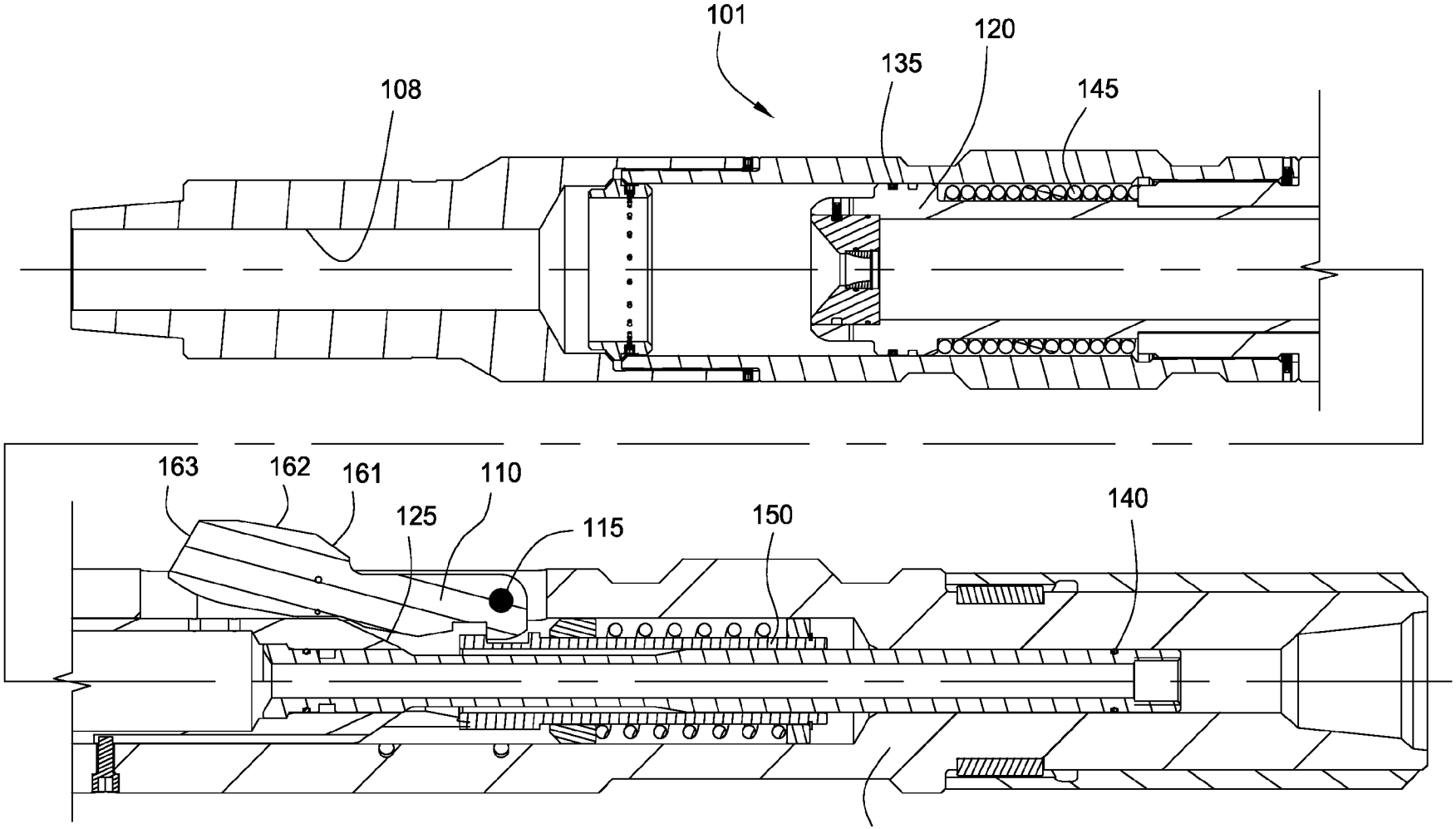
FIG. 14 shows the expandable reamer of FIG. 13 in an expanded configuration.

FIG. 14 shows the expandable reamer 101 of FIG. 13 in an expanded configuration. It can be seen that the ramp 125 has forced the cutting arm 110 outward and the spring 145 is compressed. One or more cutting structures may be provided on the exposed cutting zones, for example, front 161, middle 162, and back 163 cutting zones. The cutting structures may be adapted to remove the same or different materials. In one embodiment, the back cutting zone 163 is urged against the unexpanded portion of the expandable tubular 10 for removal of the unexpanded portion 15. To retract the cutting arms 110, fluid pressure in the bore 108 is reduced to a level below the biasing force of the spring 145. In this respect, the spring 145 may expand and urge the ramp 125 away from the cutting member 110, thereby allowing the cutting arm 110 to retract. After the ramp is removed, the spring of the return mechanism 150 expands to bias the cutting member 110 in the retracted position.

In another embodiment, the reamer may include one or more sets of cutting arms. For example, another set of cutting arms may be circumferentially disposed on the outer body at a location axially displaced from the first set of cutting arms. The cutting arms on each set may have the same or different cutting zones. For example, the first set of cutting arms may have front and middle cutting zones, and second set of cutting arms may only have a back cutting zone. It must be noted that various suitable combinations of cutting zones and cutting arms may be employed. The second set of cutting arms may be adapted to activate at a pressure different from the activating pressure of the first set of cutting arms, for example, a higher pressure.

In yet another embodiment, two or more reamers may be used in combination to extend the wellbore or remove the restriction. The cutting arms on the reamers may have the same or different cutting zones for cutting different materials or different portions of those materials. Additionally, the different cutting arms may have different diameters. The second reamer may be adapted to activate at a pressure different from the activating pressure of the first reamer, for example, a higher pressure.

It must be noted that embodiments of the present invention are not limited to expandable tubulars, but may be suitable in applications requiring drilling a well and milling of a restriction in a single trip.

While the foregoing is directed to the preferred embodiment of the present invention, other and further embodiments of the invention may be devised without departing from the basic scope thereof, and the scope thereof is determined by the claims that follow.

We claim:

1. A method of removing a restriction in a tubular located in a well, comprising:

providing a drilling assembly with a drill bit and a reamer, the reamer having a cutting structure for removing the restriction;

drilling through a lower portion of the tubular;

expanding the reamer at a location below the restriction; and urging the reamer back toward the restriction to remove the restriction.

2. The method of claim 1, further comprising continuing drilling to extend the well after expanding the reamer and before urging the reamer to remove the restriction.

3. The method of claim 2, wherein the reamer is provided with a second cutting structure for drilling the well.

4. The method of claim 1, further comprising increasing a fluid pressure above the drilling pressure, thereby expanding the reamer.

5. The method of claim 4, further comprising applying a force to retract the reamer.

6. The method of claim 1, wherein expanding the reamer comprises extending a cutting arm of the reamer radially outward.

7. The method of claim 6, wherein the reamer is hydraulically expanded.

8. The method of claim 1, further comprising expanding a portion of the tubular prior to drilling through the tubular.

9. The method of claim 6, wherein the cutting arm includes a drilling zone and a milling zone.

10. The method of claim 9, wherein drilling zone is provided with PDC, natural diamond, tungsten carbide, composite tungsten carbide, hard metal, and combinations thereof.

11. The method of claim 9, wherein milling zone is provided with tungsten carbide, composite tungsten carbide, hard metal, PDC, and combinations thereof.

12. The method of claim 7, further comprising an actuating device for moving the cutting arm to the expanded position.

13. The method of claim 12, wherein the actuating device comprises a piston for urging the cutting arm outward.

14. The method of claim 12, further comprising a retracting mechanism for retracting the cutting arm.

15. The method of claim 14, wherein the retracting mechanism comprises a sleeve engageable with the cutting arm.

16. The method of claim 15, wherein the retracting mechanism further comprises a biasing member in an extended position when the cutting arm is expanded.

17. An apparatus for removing a restriction in a tubular located in a well, comprising:

a drilling assembly having a drill bit and a reamer, wherein the reamer includes a cutting arm pivotable between an unexpanded position and an expanded position, wherein the cutting arm includes a drilling zone adapted to extend a length of the well and a milling zone adapted to expand a width of the well;

an actuating device for moving the cutting arm to the expanded position; and a retracting mechanism having a sleeve engageable with the cutting arm to return the cutting arm to the unexpanded position, wherein the sleeve is movable relative to the actuating device.

18. The apparatus of claim 17, wherein the cutting arm is expanded using a fluid pressure.

19. The apparatus of claim 18, wherein the fluid pressure for expanding the cutting arm is greater than a fluid pressure for operating the drill bit.

20. The apparatus of claim 17, wherein the drilling zone is provided with PDC, natural diamond, tungsten carbide, composite tungsten carbide, hard metal, and combinations thereof.

21. The apparatus of claim 17, wherein the milling zone is provided with tungsten carbide, composite tungsten carbide, hard metal, PDC, and combinations thereof.

22. The apparatus of claim 17, wherein the actuating device comprises a piston for urging the cutting arm outward.

23. The apparatus of claim 22, wherein the piston is hydraulically actuated.

24. The apparatus of claim 17, wherein the actuating device is activated at a higher pressure than an operating pressure of the drill bit.

25. The apparatus of claim 17, wherein the retracting mechanism further comprises a biasing member in an extended position when the cutting arm is expanded.

26. An apparatus for removing a restriction in a tubular located in a well, comprising:

a drilling assembly having a drill bit and a reamer, wherein the reamer includes a cutting arm pivotable between an unexpanded position and an expanded position, wherein the cutting arm includes a drilling zone adapted to extend a length of the well and a milling zone adapted to expand a width of the well; and a retracting mechanism having a sleeve engageable with the cutting arm to return the cutting arm to the unexpanded position, and a biasing member in an expanded position when the cutting arm is extended.

27. An apparatus for removing a restriction in a tubular located in a well, comprising:

a drilling assembly having a drill bit and a reamer, wherein the reamer includes a cutting arm pivotable between an unexpanded position and an expanded position, wherein the cutting arm includes a drilling zone adapted to extend a length of the well and a milling zone adapted to expand a width of the well;

an actuating device for moving the cutting arm to the expanded position; and a retracting mechanism includes a sleeve engageable with the cutting arm to return the cutting arm to the unexpanded position and a biasing member in an extended position when the cutting arm is expanded.

28. The apparatus of claim 27, wherein the sleeve is moved by movement of the cutting arm to the expanded position.

* * * * *